US005533717A

United States Patent [19]

Del Raso

[11] Patent Number: 5,533,717

[45] Date of Patent: Jul. 9, 1996

[54] ADJUSTABLE CLAMPING STRAP

[76] Inventor: Americo Del Raso, 21858 River Oaks Dr. Apt. 3F, Rocky River, Ohio 44116

[21] Appl. No.: 270,685

[22] Filed: Jul. 5, 1994

[51] Int. Cl.[6] ..... B25B 1/20

[52] U.S. Cl. ..... 269/42; 269/131; 269/132; 269/108

[58] Field of Search ..... 254/231, 234; 24/71 R, 71 ST, 71 TD, 71.1, 68 D, 19, 279, 68 CD, 33 A, 38, 31 F, 193, 197, 200; 269/41, 42, 107–109, 130–132; 81/64

[56] References Cited

U.S. PATENT DOCUMENTS

| | | | |
|---|---|---|---|
| D. 342,595 | 12/1993 | Day . | |
| 357,597 | 2/1887 | Hazelton | 24/197 |
| 737,404 | 8/1903 | Harrison | 24/279 |
| 788,161 | 4/1905 | Marceau | 269/130 |
| 1,411,488 | 4/1922 | Gilmour | 254/234 |
| 1,458,140 | 6/1923 | Lewis | 81/64 |
| 1,514,227 | 11/1924 | Prentice | 24/296 |
| 3,108,783 | 10/1963 | Foust et al. | 254/234 |
| 3,317,974 | 5/1967 | Sisler | 24/279 |
| 3,595,559 | 7/1971 | Gettinger . | |
| 3,893,210 | 7/1975 | Hildebrandt . | |
| 4,560,153 | 12/1985 | Han | 269/42 |
| 4,718,148 | 1/1988 | McKernon et al. . | |
| 4,758,048 | 7/1988 | Shuman | 24/200 |
| 5,152,330 | 10/1992 | Heise | 269/131 |
| 5,161,789 | 11/1992 | Rogers . | |
| 5,240,236 | 8/1993 | Higrau . | |
| 5,271,648 | 12/1993 | Kravsz | 24/279 |

FOREIGN PATENT DOCUMENTS

| | | | |
|---|---|---|---|
| 606741 | 11/1925 | France | 24/197 |

*Primary Examiner*—Robert C. Watson

*Attorney, Agent, or Firm*—David L. Baker; Rhodes & Ascolillo

[57] ABSTRACT

A clamping strap for use particularly in a fabricating process of wood, metal or plastic includes a strap for encompassing the work piece and a folded adjuster plate in the strap, having a threaded eye bolt and wing nut to vary the distance between the legs of the adjuster thereby changing the force applied to the work piece by the strap. The adjuster will allow discrete changes in the force applied.

10 Claims, 3 Drawing Sheets

ADJUSTABLE CLAMPING STRAP

BACKGROUND OF THE INVENTION

1. Field of the Invention

This invention relates generally to a clamping strap and more particularly to a clamping strap that is adjustable and has particular application in the field of woodworking and cabinet making.

2. Description of the Prior Art

In the broad field of wood working there are countless times in the process of manufacture that products are clamped in position for numerous reasons such as to allow glue to dry for example. The clamp is almost as old as the mallet, saw and wood chisel and various sizes, shapes and models have been tried over the years. One persistent difficulty with the prior art clamps is the ability to micro-adjust the pressure on the work thus assuring good contact between the pieces being joined. If insufficient pressure is applied the wood will lack the structural integrity of fine woodwork and if excessive pressure is applied the glue will be forced out of the joint and look poorly and also lack soundness of structure.

A number of U.S. Patents have been granted for inventions relating to clamping straps and the following are those known to Applicant. U.S. Pat. No. 3,595,559 issued Jul. 27, 1971 to Gettinger for an Adjustable Holding Device to hold automobile bumpers while work is being performed on them. U.S. Pat. No. 3,893,210 issued Jul. 8, 1975 to Hildebrant for a strap clamp assembly adapted for uses such as fastening loads to automobiles. The U.S. Patent No. 4,718,148 to McKernon et al. issued Jan. 12, 1988 is another clamping means for a strap, adapted to be located between a strap storage location and a strap utilization location. The Rogers U.S. Pat. No. 5,161,789 issued Nov. 10, 1992 is a universal clamping device for use in woodworking or other fabricating projects and lacks the micro-adjust feature of this invention. A U.S. Pat. No. Des. 342,595 has been issued to Day for an adjustable strap that appears to function well with a sport hat band. U.S. Patent No. 5,420,236 issued Aug. 31, 1993 to Mierau discloses a strap clamp for securing logs that are to enter a particular heavy duty wood working machine.

It is easily seen that clamps of the prior art fail to provide fine adjustment and that there exists a need for just such a device as disclosed and claimed herein.

SUMMARY OF THE INVENTION

The invention is directed toward a clamping strap that is suitable for use in a fabrication process and in particular the area of wood working and wood product fabrication. The clamping strap is distinguished by the inclusion of at least one adjustment device in the strap. The strap is formed from web material, plastic or other material that is compatible with wood working and cabinet making. The strap has one end free and another end fitted with a common "D" ring clamping and locking arrangement. In use the free end of the strap is engaged by the "D" ring and quickly and easily pulled to apply a reasonable force on the work piece. Located in the strap is at least one adjustment device consisting of a rectangular sheet of metal or plastic having some substantial rigidity. The sheet is folded along a transverse axis at its mid point forming an acute angle and creating a pair of legs. The strap is connected to each leg and an eye bolt with wing nut and washer passes through each leg and varies the acute angle thereby lengthening or shortening the strap. The subtle changes in the length of the strap will vary the pressure applied to the work piece. In the event of a large work piece requiring a long strap more than one adjuster would be added to the strap.

It is therefore an object of the invention to provide a new and improved adjustable strapping clamp.

It is another object of the invention to provide a new and improved clamping strap that provides more accurate pressure control than previous known similar types of clamps.

It is a further object of the invention to provide a new and improved clamping strap that includes a wider range of fine force adjustment than prior art clamps.

It is still another object of the invention to provide a new and improved adjustable clamping strap that is simple to use and low in cost.

It is still a further object of the invention to provide a new and improved adjustable clamping strap which is of durable and reliable construction.

It is another object of the invention to provide a new and improved adjustable clamping strap which may be easily and efficiently manufactured and marketed.

These and other advantages, features and objects of the invention will become more apparent from the following description taken in connection with the illustrative embodiment in the accompanying drawings.

DETAILED DESCRIPTION OF THE PREFERRED EMBODIMENTS

Figure 1:
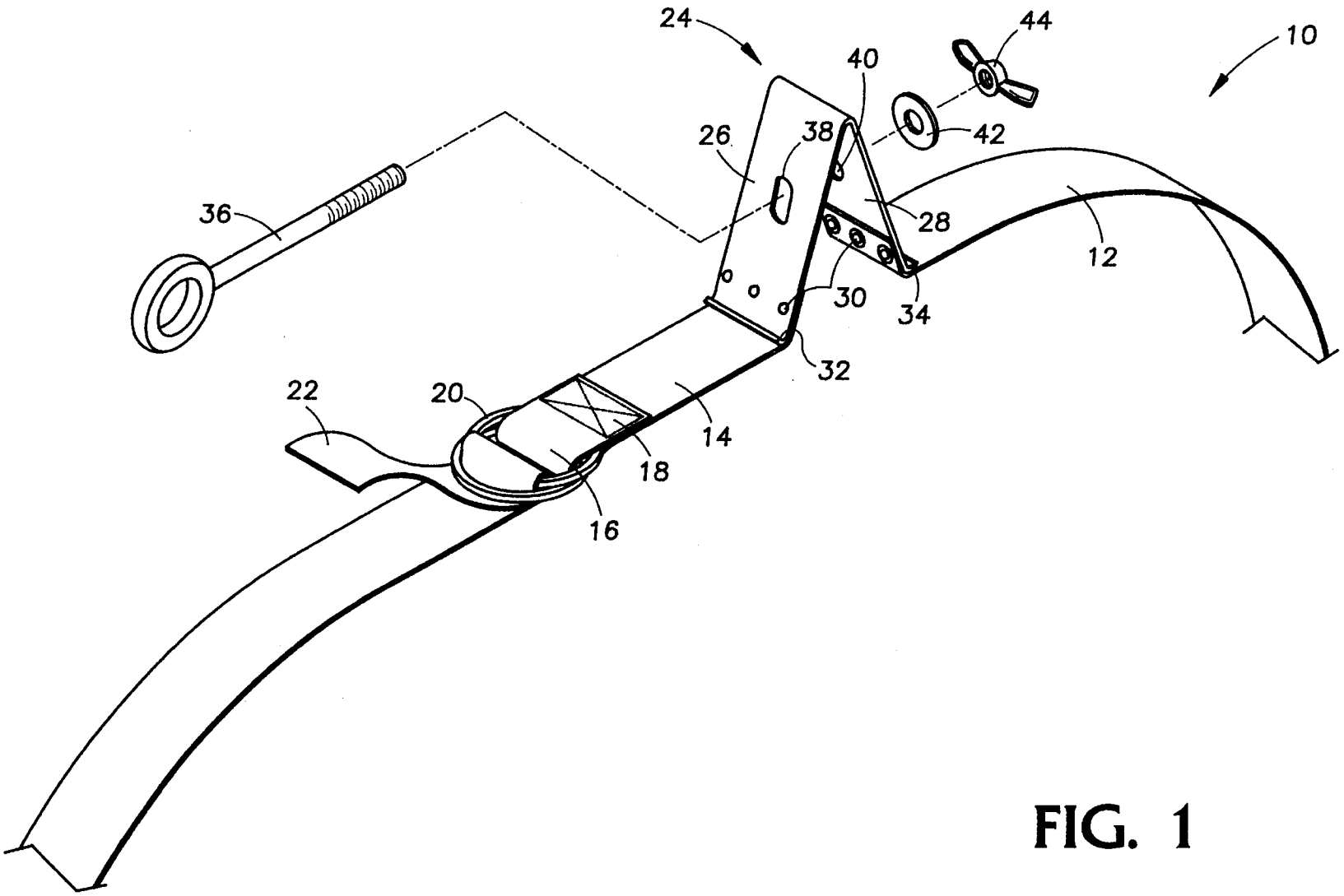
FIG. 1 is a is a perspective view of the invention showing the strap and adjuster.

Referring now to FIG. 1 the clamping strap of the invention is shown generally at 10. The strap is made up of a first strap 12 which is of any desired and useful length. A second strap 14 is generally shorter in length then the first strap but circumstances could dictate otherwise within the scope of the invention. One end of the second strap is looped at 16 and fixed back upon itself as by sewing for example at 18. Within the loop are a pair of locking rings 20 which may be common "D" rings or other suitable clamping means for engaging and locking the free end 22 of strap 12.

The strap adjuster is shown generally at 24 and is formed from a rectangular sheet of appropriate material such as metal, spring steel or plastic having sufficient rigidity to withstand the forces involved. The sheet has a width approximately equal to the width of the strap utilized. The sheet is folded along a transverse axis midway between the end points and the resulting legs 26 and 28 form acute angle "A". Straps 12 and 14 connect to the legs in any suitable manner such as rivets 30 which are affixed to the vertical portion of the leg thus eliminating the possibility of damaging the work piece. Additional protection to the work piece is provided by the arcuate termination 32,34 of legs 26,28, allowing the adjuster to slide more easily as the position of the legs is changed and the force increased.

The angle "A" is varied by means of a threaded eye bolt 36 which passes through apertures 38 and 40 centrally located in legs 26 and 28 respectively. A washer 42 acts as a bearing surface for wing nut 44 which engages eye bolt 36. Aperture 38 is generally rectangular in shape and sized to accept and nestle a portion of the eye bolt 36 thereby causing it to resist the torque forces applied when the wing nut is tightened against washer 42. In effect, the fine tune micro-adjust feature of the invention may be performed with one hand allowing the other hand to be free for checking alignment and other tasks.

Figure 2:
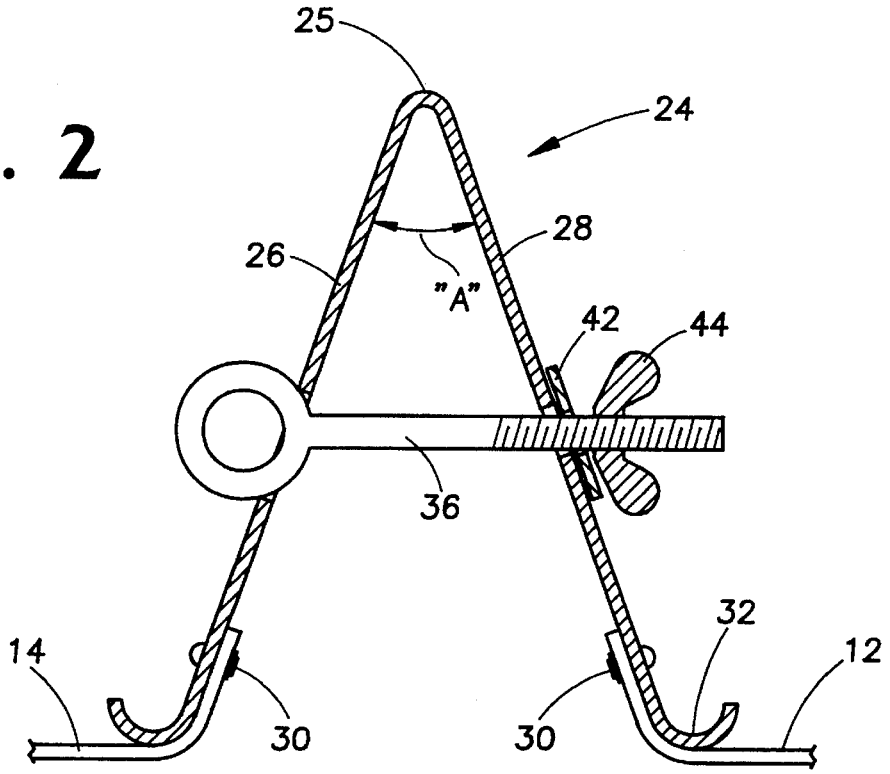
FIG. 2 is a side elevation view partly in cross section of the adjuster in an open condition.
Figure 3:
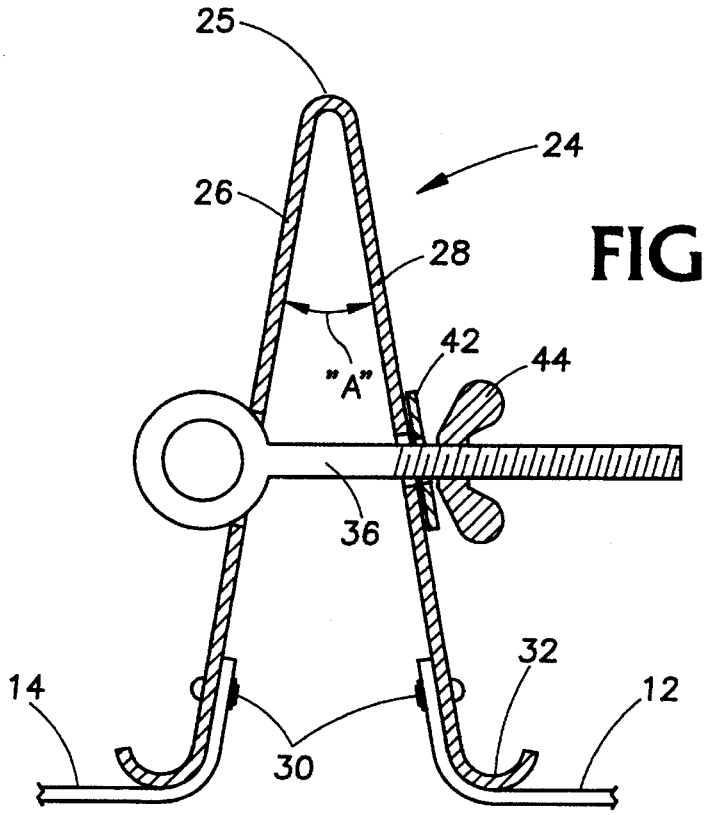
FIG. 3 is a side elevation view,partly in cross section, of the adjuster in a closed condition.

Referring to FIGS. 2 and 3 illustrate the operation of the adjuster, in FIG. 2 wing nut 44 is proximate the end of threaded eye bolt 36, thereby allowing legs 26 and 28 to expand and increase the apex angle "A". This is the condition for the initial installation of the strap around a work piece. Once straps 12 and 14 have been engaged and locked (FIG. 1) wing nut 44 is turned down causing the legs to come together decreasing apex angle "A". The apex angle has a range from approximately 90 degrees open to 0 degrees closed.

Figure 4:
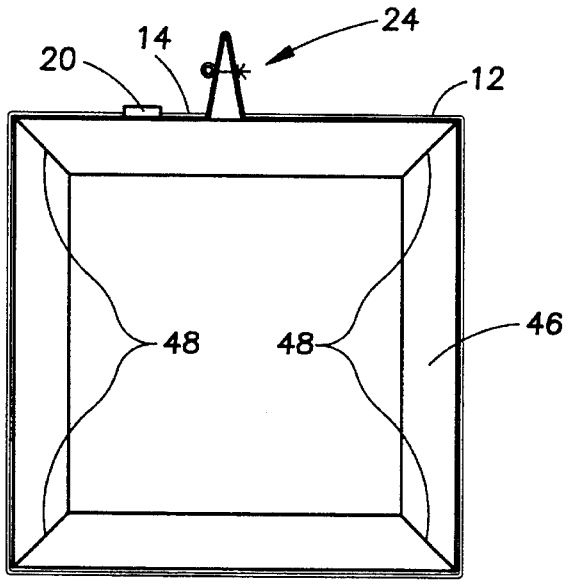
FIG. 4 is a plan view showing the invention clamping an object.
Figure 5:
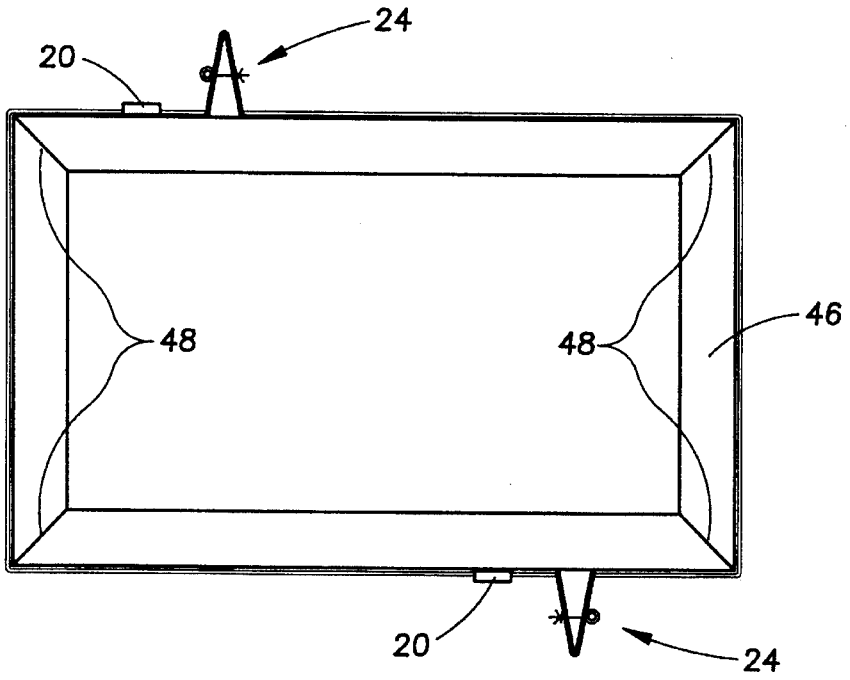
FIG. 5 is a plan view showing an alternative embodiment clamping an object.

FIGS. 4 and 5 show examples of the adjustable strapping clamp in use, a picture frame 46 is clamped by straps 12 and 24 with lock 20 joining the straps and adjuster 24 applying the exact force to the joints 48 desired by the craftsman. FIG. 5 shows the use of two strapping clamps joined to clamp a large frame and apply even force to the joints with the double adjusting means.

It should be understood, of course, that the foregoing disclosure relates to only a preferred embodiment of the invention and tat numerous modifications of alteration may be made therein without departing from the spirit and scope of the appended claims.

What is claimed is:

1. An adjustable strapping clamp comprising:

an adjustable connector receiving means comprising:
a generally rectilinear shape;
a first end; and
a second end;

a first elongated strap;

a second elongated strap;

the first end adapted to receive a first connecting end of the first elongated strap;

the second end adapted to receive a second connecting end of the second elongated strap;

the first elongated strap affixed to the connector receiving means at the first connecting end by a plurality of rivets passing through the connector receiving means and the first elongated strap;

the first elongated strap having a first securing end;

the second connecting end of the second elongated strap affixed to the connector receiving means at the second end;

the second elongated strap affixed to the connector receiving means at the second connecting end by a plurality of rivets passing through the connector receiving means and the second elongated strap;

the second elongated strap having a strap receiving and locking means, comprising a pair of "D" affixed at a second securing end for receiving the free end of the first elongated strap;

the connecting receiver means is folded at an acute angle along a midpoint of a transverse axis forming a pair of legs causing the first end and the second end to become more proximate as the acute angle of the fold approaches zero degrees;

the pair of legs having ends, distal the fold, having an arcuate shape substantially parallel to the surface of the elongated strap connected thereto; and means, extending through the legs, for adjustably changing the angle of the connector receiving means.

2. An adjustable strapping clamp according to claim 1 wherein the means for adjustably changing the angle is an eye bolt having a washer and wing nut.

3. An adjustable strapping clamp according to claim 2 including an aperture for said eye bolt in the leg of the connector having a rectangular shape and smaller in dimension then the eye bolt but of sufficient size to allow the eye to nestle therein without rotating in response to a torque force supplied by rotation of the wing nut.

4. An adjustable strapping clamp according to claim 1 including a second adjustable connector receiving means folded at an acute angle and connected to the second elongated strap.

5. An adjustable strapping clamp according to claim 4 wherein the connector receiving means is metal.

6. An adjustable strapping clamp according to claim 4 wherein the connector receiving means is plastic.

7. An adjustable strapping clamp according to claim 4 wherein the connector receiving means is spring steel.

8. An adjustable strapping clamp according to claim 4 wherein the first and second elongated straps are web material.

9. An adjustable strapping clamp according to claim 4 wherein the first and second elongated straps are metal.

10. An adjustable strapping clamp according to claim 4 wherein the connector receiving means and first and second elongated straps are plastic.

* * * * *